US009264838B2

(12) United States Patent
Stein et al.

(10) Patent No.: US 9,264,838 B2
(45) Date of Patent: Feb. 16, 2016

(54) SYSTEM AND METHOD FOR VARIABLE DECORRELATION OF AUDIO SIGNALS

(71) Applicant: DTS, Inc., Calabasas, CA (US)

(72) Inventors: Edward Stein, Capitola, CA (US); Martin Walsh, Scotts Valley, CA (US)

(73) Assignee: DTS, Inc., Calabasas, CA (US)

( * ) Notice: Subject to any disclaimer, the term of this patent is extended or adjusted under 35 U.S.C. 154(b) by 143 days.

(21) Appl. No.: 14/138,786

(22) Filed: Dec. 23, 2013

(65) Prior Publication Data

US 2014/0185811 A1 Jul. 3, 2014

Related U.S. Application Data

(60) Provisional application No. 61/746,292, filed on Dec. 27, 2012.

(51) Int. Cl.

| | |
|---|---|
| ***H04S 7/00*** | (2006.01) |
| *H04S 3/00* | (2006.01) |
| *H04S 5/00* | (2006.01) |

(52) U.S. Cl.

CPC ..... *H04S 7/307* (2013.01); *H04S 3/004* (2013.01); *H04S 5/00* (2013.01); *H04S 2400/03* (2013.01); *H04S 2420/01* (2013.01)

(58) Field of Classification Search

None

See application file for complete search history.

(56) References Cited

U.S. PATENT DOCUMENTS

| | | | | |
|---|---|---|---|---|
| 8,000,485 | B2 | 8/2011 | Walsh et al. | |
| 8,374,355 | B2 | 2/2013 | Laroche | |
| 8,488,796 | B2 | 7/2013 | Jot | |
| 2002/0154783 | A1 | 10/2002 | Fincham | |
| 2007/0223749 | A1 | 9/2007 | Kim et al. | |
| 2008/0037796 | A1 | 2/2008 | Jot et al. | |
| 2008/0126104 | A1* | 5/2008 | Seefeldt | G10L 19/008 704/503 |
| 2008/0240467 | A1 | 10/2008 | Oliver | |
| 2008/0247558 | A1 | 10/2008 | Laroche et al. | |
| 2009/0279706 | A1* | 11/2009 | Takashima | H04S 3/008 381/17 |
| 2009/0292544 | A1 | 11/2009 | Virette et al. | |
| 2011/0194712 | A1* | 8/2011 | Potard | H04S 1/002 381/300 |
| 2011/0211702 | A1 | 9/2011 | Mundt et al. | |
| 2011/0264456 | A1 | 10/2011 | Koppens et al. | |
| 2012/0170757 | A1 | 7/2012 | Kraemer et al. | |
| 2013/0166307 | A1* | 6/2013 | Vernon | G10L 19/008 704/500 |

OTHER PUBLICATIONS

PCT International Search Report and Written Opinion mailed May 15, 2014 regarding International Application No. PCT/US2013/077568.

(Continued)

*Primary Examiner* — Brenda Bernardi

(74) *Attorney, Agent, or Firm* — Blake Welcher; William Johnson; Craig Fischer

(57) ABSTRACT

Various embodiments relate to a system and method for decorrelating an audio signal with a hybrid filter. The hybrid filter is generated by first generating a decorrelation filter. A frequency-dependent warping is applied to the decorrelation filter. The warped decorrelation filter is then mixed with a carrier filter to generate the hybrid filter. The carrier filter may include filters for spatial processing of an audio signal, filters for upmixing an audio signal, and/or filters for downmixing an audio signal.

18 Claims, 2 Drawing Sheets

(56) References Cited

OTHER PUBLICATIONS

Kendall, G.S., "The Decorrelation of Audio Signals and Its Impact on Spatial Imagery", Computer Music Journal, 19:4, pp. 71-87, Winter 1995, Center for Music Technology, School of Music, Northwestern University, Evanston, Illinois, USA.

International Preliminary Examining Authority International Preliminary Report on Patentability (Chapter II of the Patent Cooperation Treaty), mailed Nov. 24, 2014, in related PCT International Application No. PCT/US2013/077568, 9 pages.

* cited by examiner

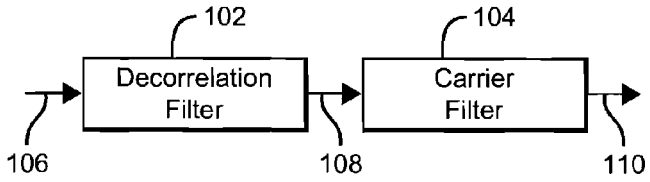
FIG. 1A (Prior Art)
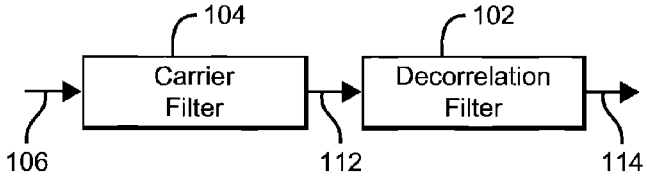
FIG. 1B (Prior Art)
FIG. 2
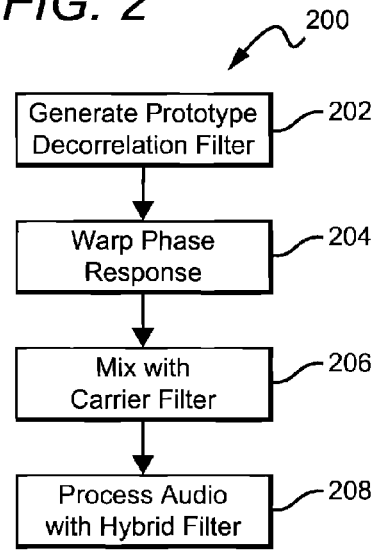
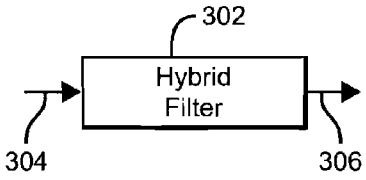
FIG. 3
FIG. 4
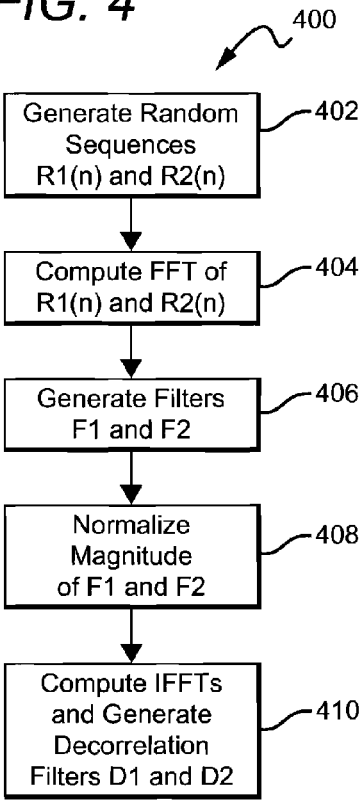

FIG. 5
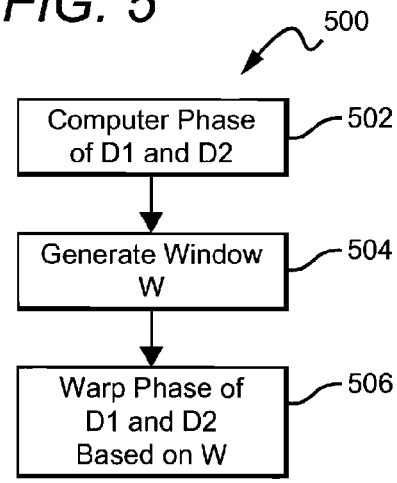
FIG. 7
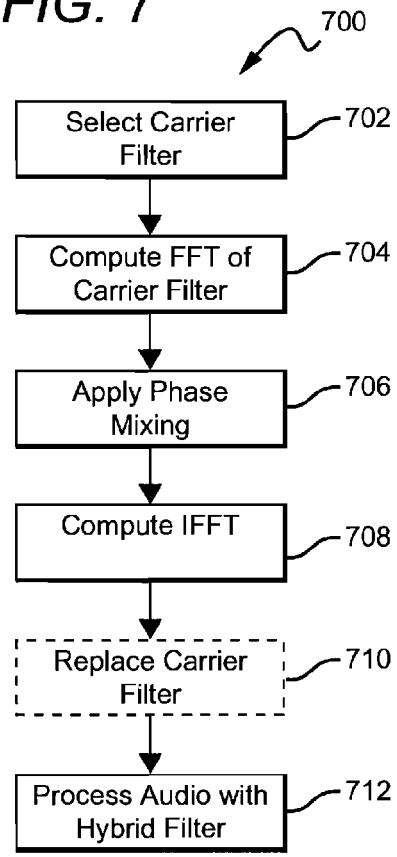
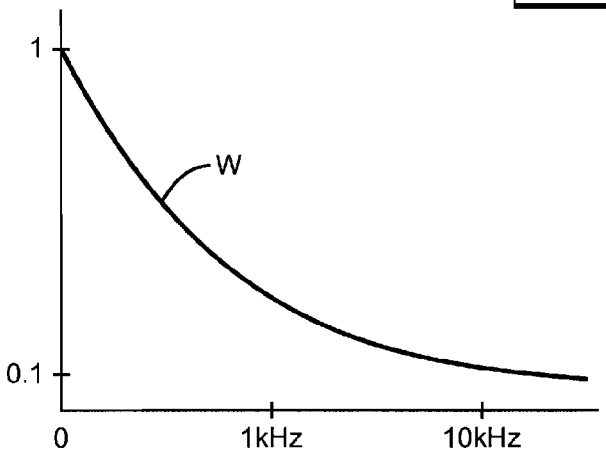
FIG. 6

SYSTEM AND METHOD FOR VARIABLE DECORRELATION OF AUDIO SIGNALS

CROSS-REFERENCE TO RELATED APPLICATIONS

This application claims priority to provisional application No. 61/746,292, filed on Dec. 27, 2012, which is incorporated herein by reference.

BACKGROUND

The present invention relates to decorrelation of audio signals. Decorrelation is an audio processing technique that reduces the correlation between a set of audio signals. Decorrelation may be used to modify the perceived spatial imagery of an audio signal. Examples of how decorrelation may be used to modify spatial imagery include: decreasing the "phantom" source effect between a pair of audio channels; widening the perceived distance between a pair of audio channels; improving the externalization of an audio signal when it is reproduced over headphones; and/or increasing the perceived diffuseness in a reproduced sound field.

A common method of reducing correlation between two (or more) audio signals is to randomize the phase of each audio signal. For example, two all-pass filters, each based upon different random phase calculations in the frequency domain, may be used to filter each audio signal. However, the decorrelation may introduce timbral changes or other unintended artifacts into the audio signals.

SUMMARY

A brief summary of various exemplary embodiments is presented. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

Embodiments of the present invention relate to a method for decorrelating an audio signal, including: generating a decorrelation filter; applying a frequency-dependent warping to the decorrelation filter to generate a warped decorrelation filter; mixing the warped decorrelation filter with a carrier filter to generate a hybrid filter; and processing an audio signal with the hybrid filter.

In some particular embodiments, generating the decorrelation filter includes: generating a sequence of random numbers; computing a fast Fourier transform (FFT) for the sequence of random numbers; normalizing the magnitude of the FFT of the sequence of random numbers to unity; and computing an inverse FFT of the normalized sequence of random numbers. In some particular embodiments, the frequency-dependent warping applies a frequency-dependent weighting to the phase of the decorrelation filter. In some particular embodiments, the frequency-dependent weighting decreases for higher frequencies. In some particular embodiments, mixing the carrier filter with the warped decorrelation filter includes subtracting the phase of the warped decorrelation filter from the phase of the carrier filter to generate a hybrid filter phase. In some particular embodiments, the method further includes: generating the hybrid filter by combining the magnitude of the carrier filter with the hybrid filter phase. In some particular embodiments, the carrier filter includes at least one binaural room impulse response (BRIR) filter. In some particular embodiments, the carrier filter includes at least one head related transfer function (HRTF) filter. In some particular embodiments, the carrier filter includes at least one filter for upmixing an audio signal. In some particular embodiments, the carrier filter includes at least one filter for downmixing an audio signal.

Embodiments of the present invention further relate to a non-transitory processor-readable storage medium having instructions stored thereon that cause one or more processors to perform a method of decorrelating an audio signal, the method including: generating a decorrelation filter; applying a frequency-dependent warping to the decorrelation filter to generate a warped decorrelation filter; mixing the warped decorrelation filter with a carrier filter to generate a hybrid filter; and processing an audio signal with the hybrid filter.

In some particular embodiments, generating the decorrelation filter includes: generating a sequence of random numbers; computing a fast Fourier transform (FFT) for the sequence of random numbers; normalizing the magnitude of the FFT of the sequence of random numbers to unity; and computing an inverse FFT of the normalized sequence of random numbers. In some particular embodiments, the frequency-dependent warping applies a frequency-dependent weighting to the phase of the decorrelation filter. In some particular embodiments, the frequency-dependent weighting decreases for higher frequencies. In some particular embodiments, mixing the carrier filter with the warped decorrelation filter includes subtracting the phase of the warped decorrelation filter from the phase of the carrier filter to generate a hybrid filter phase. In some particular embodiments, mixing the carrier filter with the warped decorrelation filter further includes generating the hybrid filter by combining the magnitude of the carrier filter with the hybrid filter phase. In some particular embodiments, the carrier filter includes at least one binaural room impulse response (BRIR) filter. In some particular embodiments, the carrier filter includes at least one head related transfer function (HRTF) filter. In some particular embodiments, the carrier filter includes at least one filter for upmixing an audio signal. In some particular embodiments, the carrier filter includes at least one filter for downmixing an audio signal.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 1A illustrates an embodiment of a conventional audio processing system with decorrelation;

FIG. 1B illustrates an alternate embodiment of a conventional audio processing system with decorrelation;

FIG. 2 illustrates a decorrelation method that combines a decorrelation filter and a carrier filter;

FIG. 3 illustrates an embodiment of a decorrelation system that utilizes a hybrid filter;

FIG. 4 illustrates an embodiment of a method for generating a pair of prototype decorrelation filters;

FIG. 5 illustrates an embodiment of a method for warping a pair of prototype decorrelation filters;

FIG. 6 illustrates an example of a window for warping a decorrelation filter; and FIG. 7 illustrates an embodiment of a method for mixing a warped decorrelation filter with a carrier filter.

DESCRIPTION

The detailed description set forth below in connection with the appended drawings is intended as a description of the presently preferred embodiment of the invention, and is not intended to represent the only form in which the present invention may be constructed or utilized. The description sets forth the functions and the sequence of steps for developing and operating the invention in connection with the illustrated embodiment. It is to be understood, however, that the same or equivalent functions and sequences may be accomplished by different embodiments that are also intended to be encompassed within the spirit and scope of the invention. It is further understood that the use of relational terms such as first and second, and the like are used solely to distinguish one from another entity without necessarily requiring or implying any actual such relationship or order between such entities.

The present invention concerns processing audio signals, which is to say signals representing physical sound. These signals are represented by digital electronic signals. In the discussion which follows, analog waveforms may be shown or discussed to illustrate the concepts; however, it should be understood that typical embodiments of the invention will operate in the context of a time series of digital bytes or words, said bytes or words forming a discrete approximation of an analog signal or (ultimately) a physical sound. The discrete, digital signal corresponds to a digital representation of a periodically sampled audio waveform. As is known in the art, for uniform sampling, the waveform must be sampled at a rate at least sufficient to satisfy the Nyquist sampling theorem for the frequencies of interest. For example, in a typical embodiment a uniform sampling rate of approximately 44.1 kHz may be used. Higher sampling rates such as 96 kHz may alternatively be used. The quantization scheme and bit resolution should be chosen to satisfy the requirements of a particular application, according to principles well known in the art. The techniques and apparatus of the invention typically would be applied interdependently in a number of channels. For example, it could be used in the context of a "surround" audio system (having more than two channels).

As used herein, a "digital audio signal" or "audio signal" does not describe a mere mathematical abstraction, but instead denotes information embodied in or carried by a physical medium capable of detection by a machine or apparatus. This term includes recorded or transmitted signals, and should be understood to include conveyance by any form of encoding, including pulse code modulation (PCM), but not limited to PCM. Outputs or inputs, or indeed intermediate audio signals could be encoded or compressed by any of various known methods, including MPEG, ATRAC, AC3, or the proprietary methods of DTS, Inc. as described in U.S. Pat. Nos. 5,974,380; 5,978,762; and 6,487,535. Some modification of the calculations may be required to accommodate that particular compression or encoding method, as will be apparent to those with skill in the art.

The present invention may be implemented in a consumer electronics device, such as a DVD or BD player, TV tuner, CD player, handheld player, Internet audio/video device, a gaming console, a mobile phone, or the like. A consumer electronic device includes a Central Processing Unit (CPU) or a Digital Signal Processor (DSP), which may represent one or more conventional types of such processors, such as ARM processors, x86 processors, and so forth. A Random Access Memory (RAM) temporarily stores results of the data processing operations performed by the CPU or DSP, and is interconnected thereto typically via a dedicated memory channel. The consumer electronic device may also include permanent storage devices such as a hard drive, which are also in communication with the CPU or DSP over an I/O bus. Other types of storage devices such as tape drives, optical disk drives may also be connected. Additional devices such as microphones, speakers, and the like may be connected to the consumer electronic device.

The consumer electronic device may utilize an operating system having a graphical user interface (GUI), such as WINDOWS from Microsoft Corporation of Redmond, Wash., MAC OS from Apple, Inc. of Cupertino, Calif., various versions of mobile GUIs designed for mobile operating systems such as Android, iOS, and so forth. The consumer electronic device may execute one or more computer programs. Generally, the operating system and computer programs are tangibly embodied in a non-transitory computer-readable medium, e.g. one or more of the fixed and/or removable data storage devices including the hard drive. Both the operating system and the computer programs may be loaded from the aforementioned data storage devices into the RAM for execution by the CPU or DSP. The computer programs may comprise instructions which, when read and executed by the CPU or DSP, cause the same to perform the steps to execute the steps or features of the present invention.

The present invention may have many different configurations and architectures. Any such configuration or architecture may be readily substituted without departing from the scope of the present invention. A person having ordinary skill in the art will recognize the above described sequences are the most commonly utilized in computer-readable mediums, but there are other existing sequences that may be substituted without departing from the scope of the present invention.

Elements of one embodiment of the present invention may be implemented by hardware, firmware, software or any combination thereof. When implemented as hardware, the present invention may be employed on one audio signal processor or distributed amongst various processing components. When implemented in software, the elements of an embodiment of the present invention are essentially the code segments to perform the necessary tasks. The software preferably includes the actual code to carry out the operations described in one embodiment of the invention, or code that emulates or simulates the operations. The program or code segments can be stored in a processor or non-transitory machine accessible medium or transmitted by a computer data signal embodied in a carrier wave, or a signal modulated by a carrier, over a transmission medium. The "non-transitory processor readable or accessible medium" or "non-transitory machine readable or accessible medium" may include any medium that can store, transmit, or transfer information.

Examples of the non-transitory processor readable medium include an electronic circuit, a semiconductor memory device, a read only memory (ROM), a flash memory, an erasable ROM (EROM), a floppy diskette, a compact disk (CD) ROM, an optical disk, a hard disk, a fiber optic medium, etc. The computer data signal may include any signal that can propagate over a transmission medium such as electronic network channels, optical fibers, air, electromagnetic, RF links, etc. The code segments may be downloaded via computer networks such as the Internet, Intranet, etc. The non-transitory machine accessible medium may be embodied in an article of manufacture. The non-transitory machine accessible medium may include data that, when accessed by a machine, cause the machine to perform the operation described in the following. The term "data" here refers to any type of information that is encoded for machine-readable purposes. Therefore, it may include program, code, data, file, etc.

All or part of an embodiment of the invention may be implemented by software. The software may have several modules coupled to one another. A software module is coupled to another module to receive variables, parameters, arguments, pointers, etc. and/or to generate or pass results, updated variables, pointers, etc. A software module may also be a software driver or interface to interact with the operating system running on the platform. A software module may also be a hardware driver to configure, set up, initialize, send and receive data to and from a hardware device.

One embodiment of the invention may be described as a process which is usually depicted as a flowchart, a flow diagram, a structure diagram, or a block diagram. Although a block diagram may describe the operations as a sequential process, many of the operations can be performed in parallel or concurrently. In addition, the order of the operations may be re-arranged. A process is terminated when its operations are completed. A process may correspond to a method, a program, a procedure, etc.

FIG. 1A illustrates an embodiment of a conventional audio processing system with decorrelation. An input audio signal 106 is processed by a decorrelation filter 102. The input audio signal 106 may be, for example, a mono signal, a stereo signal, a multi-channel surround signal (e.g. 5.1, 7.1, 11.1, 22.2, etc.), a rendering from an object-based audio renderer, or any other audio signal format. The decorrelation filter 102 reduces the correlation between at least two channels of an audio signal. If the input audio signal 106 includes only one channel of audio, then the decorrelation filter 102 may reduce the correlation between the one channel and at least one copy of the one channel. The decorrelation filter 102 outputs a decorrelated audio signal 108 to a carrier filter 104. The decorrelated audio signal 108 may include two or more decorrelated audio channels. The carrier filter 104 performs additional signal processing on the decorrelated audio signal 108 and outputs a decorrelated processed audio signal 110. The decorrelated processed audio signal 110 may include the same or a different number of audio channels as the decorrelated audio signal 108.

FIG. 1B illustrates an alternate embodiment of a conventional audio processing system with decorrelation. The carrier filter 104 may apply the same types of signal processing as the carrier filter shown in FIG. 1A. However, in this case, the carrier filter 104 does not process a decorrelated audio signal 108; instead the carrier filter 104 processes the input audio signal 106 and outputs a processed audio signal 112. The decorrelation filter 102 then reduces the correlation in the processed audio signal 112 from the carrier filter 104. If the processed audio signal 112 includes only one channel of audio, then the decorrelation filter 102 may reduce the correlation between the one channel and at least one copy of the one channel. The decorrelation filter 102 then outputs a decorrelated processed audio signal 114.

The carrier filter 104 shown in FIGS. 1A and 1B may perform spatial processing using head-related transfer functions (HRTFs), binaural room impulse responses (BRIRs), or other spatial processing techniques. For example, in FIG. 1A, the carrier filter 104 may output a decorrelated processed audio signal 110 that includes two channels of audio for rendering over headphones. When the decorrelated processed audio signal 110 is rendered over headphones, a listener may perceive that the audio content is being rendered by virtual loudspeakers in a room rather than by the headphones. The number of virtual loudspeakers may correspond to the number of audio channels in the input audio signal 106.

Alternatively or in addition, the carrier filter 104 shown in FIGS. 1A and 1B may perform upmix or downmix processing to change the number of channels output by the audio processing system. For example, in FIG. 1B, the carrier filter 104 may apply filtering and masking in order to generate five channels from a two channel input audio signal 106. Two or more of these five channels may then be decorrelated by the decorrelation filter 102.

The decorrelation filter 102 and the carrier filter 104 shown in FIGS. 1A and 1B may include multiple individual filters depending on the number of audio channels that are input into each filter and the number of audio channels that are output by each filter. For example, in FIG. 1A, if the input audio signal 106 includes two channels of audio, then the decorrelation filter 102 may include a left decorrelation filter and a right decorrelation filter. If the carrier filter 104 applies spatial processing to the two channel, decorrelated audio signal 108, then the carrier filter 104 may include a left channel/left ear filter, a left channel/right ear filter, a right channel/left ear filter, and a right channel/right ear filter. The left ear filter outputs and the right ear filter outputs may then be combined, and the carrier filter may output a two channel, decorrelated processed audio signal.

The order in which the decorrelation filter 102 and the carrier filter 104 process an audio signal may affect the sound of the output audio signal. For example, the decorrelation filter 102 may introduce unintended distortions into a signal processed by the carrier filter 104, and vice versa. The unintended distortions may include negative modifications to the timbre of the output audio signal, negative modifications to the perceived location of virtualized audio sources, or other negative audio artifacts.

FIG. 2 illustrates a decorrelation method 200 that combines a decorrelation filter and a carrier filter into one hybrid filter. Generally, the phase response of the decorrelation filter is mixed with the carrier filter. The carrier filter may include spatial processing filters, such as HRTFs or BRIRs. Alternatively or in addition, the carrier filter may include upmix/downmix processing filters (with or without virtualization), such as frequency domain masks. In the spatial processing scenarios, the phase response of the decorrelation filter is mixed with a binaural/transaural filter resulting in a hybrid filter which effectively decorrelates the input signals while virtualizing for binaural/transaural representation. In the upmix/downmix processing scenarios, the phase response of the decorrelation filter is mixed with a frequency domain mask resulting in a hybrid filter which effectively decorrelates while simultaneously distributing the audio to new channels.

By combining the decorrelation filter and the carrier filter into a hybrid filter, some of the unintended distortions may be reduced. In particular, when the audio content is reproduced over headphones, the externalization may be improved while the timbre is substantially preserved. In addition, memory and processor load required by the audio processing system may be reduced.

The decorrelation method 200 begins by generating at least two prototype decorrelation filters (202) which, when applied, achieve a desired degree of decorrelation. The phase responses of the prototype decorrelation filters are then warped and scaled with a frequency-dependent weighting (204). Each of the warped decorrelation filters are then mixed with at least one carrier filter (206) to produce a hybrid filter. Depending on the type of carrier signal processing and input audio signal, multiple pairs of decorrelation filters and carrier filters may be mixed. The resulting hybrid filters may then perform both decorrelation and carrier signal processing on an audio signal (208) without needing separate decorrelation and carrier filters.

FIG. 3 illustrates an embodiment of a decorrelation system that utilizes a hybrid filter 302. In contrast to the conventional systems of FIGS. 1A and 1B, the decorrelation system of FIG.

3 performs both decorrelation and carrier signal processing on an input audio signal 304 using a hybrid filter 302. The hybrid filter 302 applies decorrelation at the same time as the carrier signal processing, then outputs an output audio signal 306. The output audio signal 306 may then be transmitted to an audio reproduction system or other audio processing system. The audio reproduction system generates audible audio signals from the output audio signal 306 by utilizing well known reproduction techniques. The audible audio signals may be generated by any transducer devices, such as loudspeakers, headphones, earbuds, and the like.

Similar to the audio processing system of FIGS. 1A and 1B, the carrier signal processing of FIG. 3 may include spatial processing using HRTFs, BRIRs, or other spatial processing techniques. Alternatively or in addition, the carrier signal processing may include upmix or downmix processing to change the number of output channels in the output audio signal 306.

By folding decorrelation into the carrier signal processing, the hybrid filter 302 requires less memory and processor load than the filters shown in FIGS. 1A and 1B. The combination of decorrelation and carrier signal processing may be applied using no more memory and processor load than required by the carrier signal processing alone. In addition, the decorrelation and carrier signal processing may be integrated together in such a way as to reduce unintended distortions and to better preserve a desired timbre of the output audio signal 306.

FIG. 4 illustrates an embodiment of a method 400 for generating a pair of prototype decorrelation filters. The prototype decorrelation filters are designed to have "neutral-timbre"—meaning the decorrelation filters introduce minimal changes to the timbre of the decorrelated audio signals. In conventional decorrelation filter design, a randomized phase response is computed directly in the frequency domain, combined with weights based on a target correlation coefficient C, and the magnitude response is normalized to unity. This conventional method may introduce timbral changes in the decorrelated audio signal, and the amount of decorrelation may vary significantly from the target. In accordance with a particular embodiment of the present invention, it was found that a closer match to the target correlation coefficient, with neutral-timbre, may be obtained by computing random time-domain samples and converting them to the frequency-domain for phase manipulation. The frequency-domain signals are then calculated based on the target correlation coefficient C, and normalized.

More specifically, the pair of prototype decorrelation filters are generated as shown in FIG. 4. First, two random sequences of numbers, R1($n$) and R2($n$), are generated (402). The sequences R1($n$) and R2($n$) each have a length N, and the values of the numbers range between −1 and 1. The sequences may be generated using traditional random number generation techniques, and preferably utilize a Gaussian or other similar distribution. The sequences R1($n$) and R2($n$) are then converted into their frequency domain versions R1 and R2 using a fast Fourier transform (FFT) (404). Optionally, the magnitude of R1 and R2 may be normalized to unity. Filters F1 and F2 are then generated from the frequency domain versions R1 and R2 (406). The filters F1 and F2 are dependent upon the amount of correlation desired in the resulting prototype decorrelation filters. The first filter F1 is used as an anchor and the second filter F2 is varied based on the target correlation coefficient C, having a value between −1 and 1. If $C>0$, then F1=R1 and F2=(1−C)*R2+C*R1. If $C<0$, then F1=R1, and F2=(1−|C|)*R2−|C|*R1. Once filters F1 and F2 are generated, their magnitudes are normalized to unity (408). The normalized filters F1 and F2 are then converted back to the time domain using an inverse fast Fourier transform (IFFT), resulting in finite impulse response (FIR) prototype decorrelation filter D1 and D2 (410). The prototype decorrelation filter D1 and D2 share a prescribed correlation, with filter D1 serving as an "un-voiced" timbre anchor filter.

In addition, the prototype decorrelation filters may be time-varying. The sets of filter coefficients generated previously may be swapped out or interpolated over time. Since the magnitude of the decorrelation filters is consistent, moving peaks are not produced. In the frequency domain, time-manipulations may be achieved by manipulating the phase of the decorrelation filters directly.

FIG. 5 illustrates an embodiment of a method 500 for warping the pair of prototype decorrelation filters D1 and D2. First, the phases of decorrelation filters D1 and D2 are determined (502) from the frequency domain versions of the filters by using an FFT. Next a window W is generated (504) that determines the warping of the decorrelation filters D1 and D2. The window W is used to determine the amount of frequency-dependent weighting to apply to the phase of the filters D1 and D2. An example of a window W is shown in FIG. 6. As the frequency increases, the value of the weighting to apply to the phase is decreased. The window values may be squared one or more times to accelerate the decrease in weighting toward the higher frequencies, or other weighting schemes may be used, such as linear, sinusoidal, etc. The shape of the window W may be designed to control the tradeoff between neutral timbre at higher frequencies and the decorrelation effect at lower frequencies. Once the window W is determined, it may be used to warp the phase responses of the decorrelation filters D1 and D2 (506) by applying a frequency-dependent weighting to the phases. By warping the phase of the decorrelation filters D1 and D2 with the window W, decorrelation is maintained at the lower frequencies, while decorrelation is minimized at the higher frequencies. This may help to preserve the perceptual audio effects of the carrier filter when the carrier filter and decorrelation filters are mixed. This may also help minimize timbral modifications when the carrier filter and decorrelation filter are mixed.

FIG. 7 illustrates an embodiment of a method 700 for mixing a warped decorrelation filter with a carrier filter. First a carrier filter is selected (702). The selected carrier filter may apply a desired type of audio signal processing, such as spatial signal processing and/or upmix/downmix processing as previously discussed, and/or other types of audio signal processing. The carrier filter preferable includes one or more finite impulse response (FIR) filters. If the selected carrier filter is longer than the prototype decorrelation filters (length N), then only the first N taps of the carrier filter are selected. If the selected carrier filter is shorter than the prototype decorrelation filters, then the tail is filled with zeroes to match the length of the prototype decorrelation filters. Once a carrier filter of equal length is selected, the magnitude (||CarrierFilter||) and phase (CarrierPhase) of the carrier filter is determined by converting it to the frequency domain using an FFT (704). The warped decorrelation filter and carrier filter may then be mixed (706). The warped decorrelation filter and the carrier filter are mixed by subtracting the phase of the warped decorrelation filter (DecorrPhase) from the phase of the carrier filter (CarrierPhase). More specifically, $$\text{HybridPhase}=\text{CarrierPhase}-\text{DecorrPhase},$$

where HybridPhase represents the phase of the hybrid filter. Subtracting the DecorrPhase from the CarrierPhase may produce a result more perceptually consistent with true signal decorrelation than if the phases were added. Also, by subtracting in the frequency domain, the decorrelation effect may be more easily varied across each frequency bin by modifying the frequency-dependent warping. From the HybridPhase, the frequency domain representation of the hybrid filter is generated:

$$\text{HybridFilter}=\|\text{CarrierFilter}\|[\cos(\text{HybridPhase})+j\sin(\text{HybridPhase})].$$

The frequency domain representation of the hybrid filter (HybridFilter) provides a magnitude response very similar to that of the original frequency domain carrier filter. An adaptive normalization step may be utilized to correct any differences in the magnitude of the hybrid filter compared to the original carrier filter. This may be achieved by iterative normalizations of the magnitude of the frequency domain hybrid filter towards the magnitude of the original frequency domain carrier filter.

The normalized frequency domain hybrid filter is then converted to the time domain using an IFFT, resulting in a finite impulse response (FIR) hybrid filter (708). If the original carrier filter was longer than the prototype decorrelation filter, then the first N taps of the original carrier filter are replaced with the FIR hybrid filter (710). Then the hybrid filter may be used to process audio signals (712). The processed audio signals may then be output to an audio reproduction system or other audio processing system. The audio reproduction system generates audible audio signals from the processed audio signals by utilizing well known reproduction techniques. The audible audio signals may be generated by any transducer devices, such as loudspeakers, headphones, earbuds, and the like.

It should be understood that the number of prototype decorrelation filters and carrier filters may vary depending on the number of input channels, output channels, and type of processing performed by the carrier filters. One skilled in the art should recognize how to modify the disclosed systems and methods to account for the number of necessary filters, and mix the phases of the filters accordingly to generate the necessary hybrid filters.

Note that if the carrier filter is designed to apply spatial audio processing, then the phase mixing of the warped prototype decorrelation filters and the carrier filter is performed per channel, and not per ear. For example, prototype decorrelation filter D1 may be mixed with both a left channel/left ear filter and a left channel/right ear filter, while prototype decorrelation filter D2 may be mixed with both a right channel/left ear filter and a right channel/right ear filter.

By utilizing a FIR filter for the hybrid filter, the length of the response used for decorrelation may be more easily controlled. A higher decorrelation may be achieved without the need for a long tail (where the temporal aspects become more audible). A higher initial echo density may also be achieved, compared to conventional reverberation models. Additionally, the FIR hybrid filter may be easily ported for implementation in both time and frequency domain architectures.

In addition, the decorrelation effect of the hybrid filter may be bypassed for particular classes of signals. For example, dialog that is perceived to come from a phantom center channel may be preserved by first extracting the phantom center channel content from front left and front right input channels. The dialog may be extracted, for example, by designing a carrier filter that masks out the vocal frequency band in the front left and front right channels. After decorrelation, the phantom center content may be mixed back into the front left and front right channels.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show particulars of the present invention in more detail than is necessary for the fundamental understanding of the present invention, the description taken with the drawings making apparent to those skilled in the art how the several forms of the present invention may be embodied in practice.

What is claimed is:

1. A method for decorrelating an audio signal, comprising:

generating a decorrelation filter;

applying a frequency-dependent warping to the decorrelation filter to generate a warped decorrelation filter, wherein the frequency-dependent warping applies a frequency-dependent weighting to the phase of the decorrelation filter;

mixing the warped decorrelation filter with a carrier filter to generate a hybrid filter; and processing an audio signal with the hybrid filter.

2. The method of claim 1, wherein generating a decorrelation filter comprises:

generating a sequence of random numbers;

computing a fast Fourier transform (FFT) for the sequence of random numbers;

normalizing the magnitude of the FFT of the sequence of random numbers to unity; and computing an inverse FFT of the normalized sequence of random numbers.

3. The method of claim 1, wherein the frequency-dependent weighting decreases for higher frequencies.

4. The method of claim 1, wherein mixing the carrier filter with the warped decorrelation filter comprises:

subtracting the phase of the warped decorrelation filter from the phase of the carrier filter to generate a hybrid filter phase.

5. The method of claim 4, further comprising:

generating the hybrid filter by combining the magnitude of the carrier filter with the hybrid filter phase.

6. The method of claim 1, wherein the carrier filter comprises:

at least one binaural room impulse response (BRIR) filter.

7. The method of claim 1, wherein the carrier filter comprises:

at least one head related transfer function (HRTF) filter.

8. The method of claim 1, wherein the carrier filter comprises:

at least one filter for upmixing an audio signal.

9. The method of claim 1, wherein the carrier filter comprises:

at least one filter for downmixing an audio signal.

10. A non-transitory processor-readable storage medium having instructions stored thereon that cause one or more processors to perform a method of decorrelating an audio signal, the method comprising:

generating a decorrelation filter;

applying a frequency-dependent warping to the decorrelation filter to generate a warped decorrelation filter, wherein the frequency-dependent warping applies a frequency-dependent weighting to the phase of the decorrelation filter;

mixing the warped decorrelation filter with a carrier filter to generate a hybrid filter; and processing an audio signal with the hybrid filter.

11. The non-transitory processor-readable storage medium of claim 10, wherein generating a decorrelation filter comprises:

generating a sequence of random numbers;

computing a fast Fourier transform (FFT) for the sequence of random numbers;

normalizing the magnitude of the FFT of the sequence of random numbers to unity; and computing an inverse FFT of the normalized sequence of random numbers.

12. The non-transitory processor-readable storage medium of claim 11, wherein the frequency-dependent weighting decreases for higher frequencies.

13. The non-transitory processor-readable storage medium of claim 10, wherein mixing the carrier filter with the warped decorrelation filter comprises:

subtracting the phase of the warped decorrelation filter from the phase of the carrier filter to generate a hybrid filter phase.

14. The non-transitory processor-readable storage medium of claim 13, wherein mixing the carrier filter with the warped decorrelation filter further comprises:

generating the hybrid filter by combining the magnitude of the carrier filter with the hybrid filter phase.

15. The non-transitory processor-readable storage medium of claim 10, wherein the carrier filter comprises:

at least one binaural room impulse response (BRIR) filter.

16. The non-transitory processor-readable storage medium of claim 10, wherein the carrier filter comprises:

at least one head related transfer function (HRTF) filter.

17. The non-transitory processor-readable storage medium of claim 10, wherein the carrier filter comprises:

at least one filter for upmixing an audio signal.

18. The non-transitory processor-readable storage medium of claim 10, wherein the carrier filter comprises:

at least one filter for downmixing an audio signal.

* * * * *